US007076843B2

(12) United States Patent
Sakabayashi

(10) Patent No.: US 7,076,843 B2
(45) Date of Patent: Jul. 18, 2006

(54) SHOESTRING TYING APPARATUS

(76) Inventor: Toshiki Sakabayashi, 2-45-3, Kamikoide-machi, Maebashi City, Gunma Prefecture (JP) 371-0037

( * ) Notice: Subject to any disclaimer, the term of this patent is extended or adjusted under 35 U.S.C. 154(b) by 36 days.

(21) Appl. No.: 10/688,908

(22) Filed: Oct. 21, 2003

(65) Prior Publication Data

US 2005/0081339 A1 Apr. 21, 2005

(51) Int. Cl.
*A43C 11/00* (2006.01)

(52) U.S. Cl. ..... 24/68 SK

(58) Field of Classification Search ..... 24/68 B, 24/68 SK, 69 SK, 909, 70 SK, 71.1, 71 SK; 36/50.1, 50.5, 118.1, 118.9; 242/388.1, 389, 242/388.3, 395, 388.6, 398, 388.7, 400, 396.1, 242/396.2, 396.8

See application file for complete search history.

(56) References Cited

U.S. PATENT DOCUMENTS

| | | | | |
|---|---|---|---|---|
| 737,769 A | | 9/1903 | Preston | 242/379.2 |
| 4,261,081 A | | 4/1981 | Lott | 24/712.2 |
| 4,433,456 A | | 2/1984 | Baggio | 24/68 SK |
| 4,633,599 A | | 1/1987 | Morell et al. | 242/388.1 |
| 4,660,300 A | | 4/1987 | Morell et al. | 36/118.1 |
| 4,719,670 A | | 1/1988 | Kurt | 242/395 |
| 4,719,710 A | | 1/1988 | Pozzobon | 36/117.7 |
| 4,748,726 A | | 6/1988 | Schoch | 24/68 SK |
| 4,760,653 A | | 8/1988 | Baggio | 36/118.9 |
| 4,799,297 A | * | 1/1989 | Baggio et al. | 24/68 SK |
| 4,841,649 A | | 6/1989 | Baggio et al. | 36/117.7 |
| 4,870,723 A | | 10/1989 | Pozzobon et al. | 24/68 SK |
| 4,961,544 A | * | 10/1990 | Bidoia | 24/68 SK |
| 5,001,817 A | | 3/1991 | De Bortoli et al. | 24/68 SK |
| 5,012,598 A | | 5/1991 | Baggio et al. | 36/117.7 |
| 5,042,177 A | * | 8/1991 | Schoch | 24/68 SK |
| 5,065,480 A | | 11/1991 | De Bortoli | 24/68 SK |
| 5,150,537 A | | 9/1992 | Tacchetto et al. | 36/50.5 |
| 5,152,038 A | | 10/1992 | Schoch | 24/68 SK |
| 5,157,813 A | | 10/1992 | Carroll | 24/68 SK |
| 5,600,874 A | | 2/1997 | Jungkind | 24/68 SK |
| 5,669,116 A | | 9/1997 | Jungkind | 24/68 SK |
| 6,289,558 B1 | | 9/2001 | Hammerslag | 24/68 SK |

FOREIGN PATENT DOCUMENTS

| | | |
|---|---|---|
| EP | 0 615 705 | 9/1994 |

* cited by examiner

*Primary Examiner*—Robert J. Sandy
*Assistant Examiner*—Ruth C. Rodriguez
(74) *Attorney, Agent, or Firm*—Wenderoth, Lind & Ponack, L.L.P.

(57) ABSTRACT

A fitting portion of a rotational member of a shoestring tying apparatus is fit to a rotational cap serving as an operating member of a fastening member for winding up and fastening a shoestring. The fitting portion serves as a connection between a driving mechanism and the rotational cap. When the user pulls an operating cord serving as a portion of a driving mechanism, a rotational member is rotated, and a spring included in the rotational member is wound. The rotational cap is rotated through the fitting portion due to rotation of the rotational member, thereby quickly rotating the fastening member. Thus, the fastening member can be rotated several dozen times by an operation in which the operating cord is alternately extracted and retracted several times. This provides a shoestring tying apparatus with excellent portability and appearance for easily and quickly fastening a shoestring in a sure manner.

13 Claims, 8 Drawing Sheets

SHOESTRING TYING APPARATUS

BACKGROUND OF THE INVENTION

1. Field of the Invention

The present invention relates to a shoestring tying apparatus for easily fastening a shoestring of a sport shoe or the like in a sure manner without using fastening tension by hand.

2. Description of the Related Art

Conventionally, a shoestring is laced through eyelets provided on the opening portion of a sport shoe or the like, and both ends of the shoestring are tied tightly at the ankle of the user. With athletic shoes, tension of the shoestrings is adjusted according to the required performance.

Shoes such sport shoes including a disk for winding up a shoestring on the instep thereof are known. The ends of a shoestring, provided to the opening portion which can be opened for the user putting on or taking off the shoe, are fixed to the disk. Tension of the shoestring is adjusted according to the need of the user while winding the shoestring by rotating the disk in one direction, as disclosed in Japanese Unexamined Patent Application Publication No. 5-211906 (drawings) (which will be referred to as "patent document 1" hereafter).

On the other hand, in most cases, a conventional shoe 21 shown in FIG. 10 used for sports such as snowboarding, skiing, or the like, is formed with a great depth for fitting up above the ankle, and thus, the shoe needs to be fastened to the ankle tightly so as to allow the user supple movement. Accordingly, it is important to fasten such a shoe tightly to the ankle. In addition, shoemakers are obligated to provide a fastening member 22 integrally formed on the opening portion or the like of the shoe so as to fasten the shoestring tightly, for the safety of the user. Various types of fastening members which can be employed for the aforementioned fastening member 22 are known. For example, arrangements have been proposed as disclosed in Japanese Unexamined Patent Application Publication No. 6-237802 (all pages) (which will be referred to as "patent document 2" hereafter), Japanese Unexamined Patent Application Publication No. 7-208 (all pages) (which will be referred to as "patent document 3" hereafter), and Japanese Unexamined Patent Application Publication No. 8-506253 (FIG. 1) (which will be referred to as "patent document 4" hereafter).

The aforementioned Japanese Unexamined Patent Application Publication No. 5-211906 describes an adjusting device for adjusting the tension of the shoestring. The adjusting device has a configuration wherein both ends of a shoestring serving as a fastening member are inserted and fixed to a disk having a plate spring fixed thereto. The user pulls the plate spring fixed to the disk so as to rotate the disk for winding the shoestring to the disk, whereby tension of the shoestring can be adjusted. Note that the user should pull the plate spring only one time so as to adjust tension of the shoestring. On the other hand, the aforementioned patent documents 2 through 4 describe tying apparatuses having a configuration wherein the ends of a shoestring are integrally fixed to a winding device beforehand. The user rotates an operating rotor of the winding device several dozen times by hand in order to gradually fasten the shoestring.

The fastening member 22 for a shoestring of any of the aforementioned patent documents 2 through 4 has a configuration for fastening the shoestring 23 in a sure manner, as shown in FIG. 10. With regard to snowboard shoes or the like with a great depth for the ankle, the user rotates a rotational cap 24 or the like serving as a rotor of the fastening member 22 by hand in order to fasten the shoestring 23. However, with regard to any of the aforementioned arrangements, there is the need to rotate the aforementioned rotational cap 24 several dozen times so as to fasten the shoestring 23, which is troublesome for the user. In particular, in many cases, the fingers of the user are so numbed with cold in the winter season that securely fastening the fastening member 22 by rotating the aforementioned rotational cap 24 becomes difficult.

SUMMARY OF THE INVENTION

The present invention has been made in order to solve the aforementioned problems, and accordingly, it is an object thereof to provide a shoestring tying apparatus having an improved configuration which eliminates the above-described problem in that the user is required to rotate the operating rotor of the conventional fastening member by hand.

Another object of the present invention is to provide a shoestring tying apparatus which is small in size and easy to use.

Further, it is another object of the present invention to provide a shoestring tying apparatus for fastening a shoestring very quickly and in a sure manner, by repeating a simple pulling operation of an operating cord in one direction several times.

Furthermore, it is another object of the present invention to provide a small-sized, easy-to-use, and portable shoestring tying apparatus, having a simple configuration including a fastening member which can be detachably fit to the conventional operating rotor, thereby enabling the shoestring to be quickly fastened.

A shoestring tying apparatus according to one aspect of the present invention comprises: a fastening member for fastening a shoestring having a configuration including a disk, to which one end of the shoestring is connected, which is supported by a shaft for winding up the shoestring; and an operating rotational member for rotating the fastening member, wherein in the event of rotating the operating rotational member in a predetermined direction, the disk of the fastening disk is rotated so as to wind up the shoestring, thereby tying the shoestring, in the event of stopping rotation of the fastening member, tension of the shoestring is maintained, and in the event of releasing engagement of the operating rotational member and the fastening member, and rotating the disk in the reverse direction so as to be returned to the initial state, the shoestring is released; a connection portion for connecting to the operating rotational member; and a rotational member including driving means for rotating the connection portion, wherein the driving means is manually or automatically operated so as to rotate the operating rotational member several times, and so as to rotate the disk of the fastening member, thereby tying the shoestring.

The connection portion of the rotational member may serve as fitting means for fitting to the face of the operating rotational member.

The driving means may comprise a cylinder including an elastic member fixed to the rotational shaft thereof for winding an operating cord on the outer circumference thereof, restricting means including an engaging member disposed so as to allow the cylinder to rotate in a predetermined direction, and so as to prevent the cylinder from rotating in the reverse direction, and a connection portion for connecting to the operating rotational member, wherein upon the user pulling the operating cord wound on the outer circumference of the cylinder, the cylinder is rotated, as well as winding up the elastic member.

The rotational member may be disposed between the operating rotational member and the fastening member, and may be rotated by manual or automatic operation of the driving means of the rotational member so as to rotate the disk of the fastening member several times, thereby tying the shoestring.

The shoestring tying apparatus according to another aspect of the present invention comprises a fitting portion which rotates along with an operating rotational member connected to a fastening member for fastening a shoestring; a rotational member including a cylinder integrally formed on the fitting portion; an elastic member included within a cylinder of the rotational member, of which one end is fixed to the rotating shaft of the rotational member so that the elastic member is wound up at the time of the rotational member being rotated in the direction for tying the shoestring; a ratchet including an engaging pawl for allowing rotation in a predetermined direction, which rotates so as to return to the initial state due to the elastic force of the elastic member at the time of releasing engagement of the engaging pawl and the rotational member; an operating cord for rotating the rotational member; and a divided cover member for storing the fitting member, the rotational member including the elastic member, the ratchet, and the operating cord; wherein the operating cord can be extracted from the cover member, and at the time of extracting the operating cord, the cylinder of the rotational member and the fitting portion are rotated in the direction for tying the shoestring, as well as winding up the elastic member, and at the time of releasing the operating cord following the extracting operation, the operating cord is retracted inside due to returning action of the elastic member, and only the ratchet is rotated in the reverse direction, without the rotational member being rotated, and at the time of extracting the operating cord from the cover member again, the rotational member is rotated.

The shoestring tying apparatus according to another aspect of the present invention comprises a rotational member including one or the other of a fitting portion integrally formed on the operating rotational member and a fitting portion for fitting to the operating rotational member, and a cylinder including an internal gear on the inner face thereof disposed adjacent to the fitting portion; a ratchet including pawl-storage portions on the outer circumference thereof for storing multiple pawls for engaging with the internal gear, including an engaging opening on a predetermined side thereof, and including a shaft fitting opening at the center thereof for rotatably fitting to a rotational shaft, which is fit within the cylinder of the rotational member; a spring storage member including a protrusion on a predetermined side thereof for engaging with the engaging opening of the ratchet, including a recessed groove on the outer circumference thereof for winding up an operating cord, including a space formed therein for storing a helical spring, and including a through hole for rotatably fitting to the rotational shaft to which one end of the spring is fixed; and a cover member including a back cover, having a fitting opening on the center thereof for fitting to and supporting the rotational shaft, for covering the spring storage member, and a front cover, having an opening on the side of the fitting portion of the rotational member, for covering the entire rotational member; wherein the pawls of the ratchet for engaging with the internal gear of the rotational member are forced at all times in the direction for being engaged with the internal gear of the rotational member by an elastic member so as to be stored in the pawl-storage portions, and the rotational shaft to which one end of the spring is fixed is rotatably fit to the spring storage member, and the spring storage member including the wound spring is fit and mounted within the back cover so that one end of the rotational shaft is fit to the shaft opening of the back cover, and the protrusion of the spring storage member is engaged with the engaging opening of the ratchet of the rotational member, and one end of the operating cord is connected to the free end of the spring, and the front cover is fit to the back cover, and the other end of the operating cord can be extracted outside.

A shoestring tying apparatus according to another aspect of the present invention, integrally mounted to a shoestring for tying the shoestring, comprises: a rotational member, connected to a disc and fastening member, for rotating the disc and fastening member; a ratchet for rotating in a predetermined direction while engaging with the rotational member, but for rotating in the reverse direction without load without engaging with the rotational member; a helical spring disposed so that one end thereof is fixed to a center shaft of the rotational member, and the other end thereof is fixed to the circumference of the rotational member or is extracted outside from a slit on the circumference; an operating cord which is fixed to the outer circumference of the rotational member or the end of the helical spring extracted from the slit on the circumference, and is wound up on the outer circumference along a recessed groove formed thereon; and a cover member which covers the rotational member, includes an opening for extracting the end of the operating cord, and rotatably supports the center shaft of the rotational member; wherein upon the user extracting the operating cord outside from the opening of the cover member, the ratchet is rotated as well as winding up the helical spring, thereby rotating the disc and fastening member for the shoestring through the ratchet or the rotational member engaging with the ratchet, and thus, upon the user performing an operation wherein the operating cord is alternately extracted and retracted several times, the shoestring is tied.

With the shoestring tying apparatus according to the present invention, the fitting portion thereof is fit to the operating rotational member having the fastening member provided to the shoestring portion of the shoe. The fitting portion includes a slip-preventing member for holding the conventional operating rotational member in a sure manner.

With the shoestring tying apparatus according to the present invention, the user is not required to operate the operating rotational member connected to the conventional shoestring tying apparatus by hand. The shoestring can be fastened in a short time by user operating the operating cord several times.

With the shoestring tying apparatus according to the present invention, the cover member may be formed in the shape of a egg, ellipse, grand piano, round, square, or the like, in any desired color, so as to improve portability and appearance of the shoestring tying apparatus.

The shoestring tying apparatus according to the present invention has a simple configuration integrally formed of the spring storage member for storing the helical spring serving as a small-sized elastic member, and the ratchet, thereby enabling the shoestring tying apparatus to be manufactured with low costs.

Furthermore, the aforementioned cover member may include a connection member (in the shape as with a key-ring) for detachably connecting the shoestring tying apparatus to the user. In this case, the portability of the shoestring tying apparatus is further improved, and the user can quickly use the shoestring tying apparatus when necessary. Furthermore, this prevents the user from losing the shoestring tying apparatus.

With the shoestring tying apparatus according to the present invention, the user can fasten the shoestring very quickly and in sure manner. Furthermore, the shoestring tying apparatus is small in size and easy to use, as well as having excellent portability, so the user can carry the shoestring tying apparatus in a pocket or the like, thereby improving portability and appearance thereof.

With the shoestring tying apparatus according to the present invention, the shoestring can be easily fastened by a simple operation wherein the user fits the fitting portion thereof to the conventional rotational fastening member, and pulls the operating cord.

The shoestring tying apparatus according to the present invention relates to the conventional fastening member for fastening the shoestring of sport shoes or the like. With the shoestring tying apparatus, the user is not required to repeat rotating operation by hand several times, and furthermore, the user can fasten the shoestring easily and tightly in a sure manner, even in the winter season. Furthermore, the shoestring tying apparatus according to the present invention may be included in the conventional tying apparatus, thereby enabling the cap of the conventional tying apparatus to be easily rotated. In this case, the shoestring tying apparatus according to the present invention is included as a standardized shoestring tying apparatus, thereby providing easy-to-use shoestring tying apparatuses to the market.

BRIEF DESCRIPTION OF THE DRAWINGS

FIGS. 7A and 7B are cross-sectional diagrams for describing the internal configuration of the shoestring tying apparatus according to the second embodiment, wherein FIG. 7A shows the state wherein an operating rotor is not engaged with a rotational member, and FIG. 7B shows the state wherein the operating rotor is engaged with the rotational member;

DESCRIPTION OF THE PREFERRED EMBODIMENTS

Description will be made below regarding embodiments of a shoestring tying apparatus according to the present invention with reference to the drawings.

Figure 1:
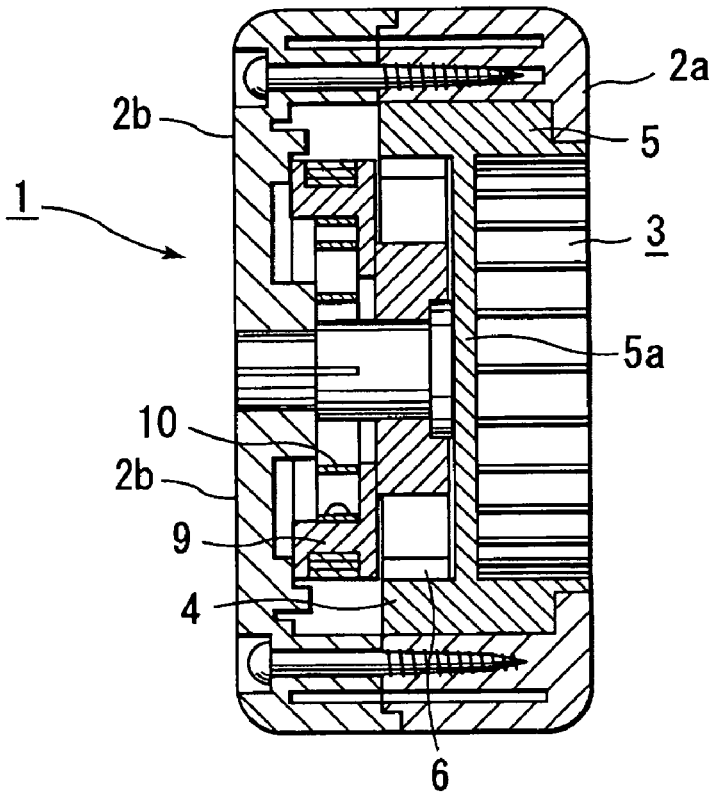
FIG. 1 is a cross-sectional diagram which illustrates a shoestring tying apparatus according to a first embodiment of the present invention.
Figure 2:
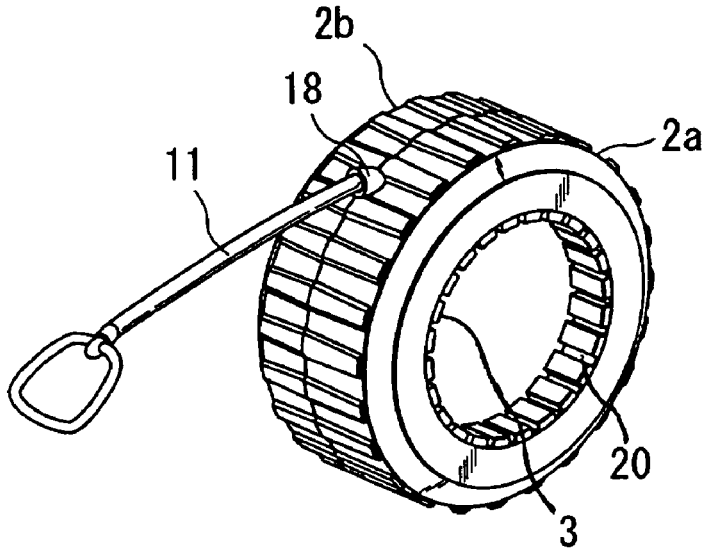
FIG. 2 is a perspective view which illustrates the overall shoestring tying apparatus according to the first embodiment of the present invention.
Figure 3:
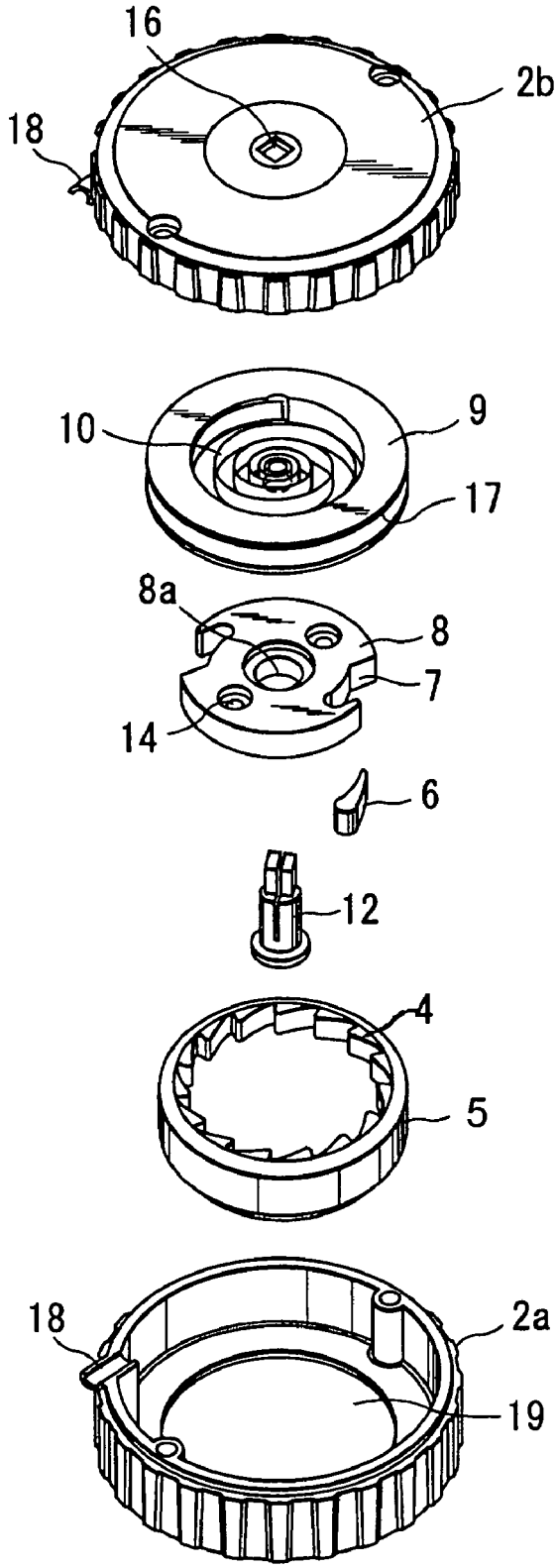
FIG. 3 is a disassembled perspective view of the shoestring tying apparatus according to the first embodiment shown in FIG. 2.
Figure 4:
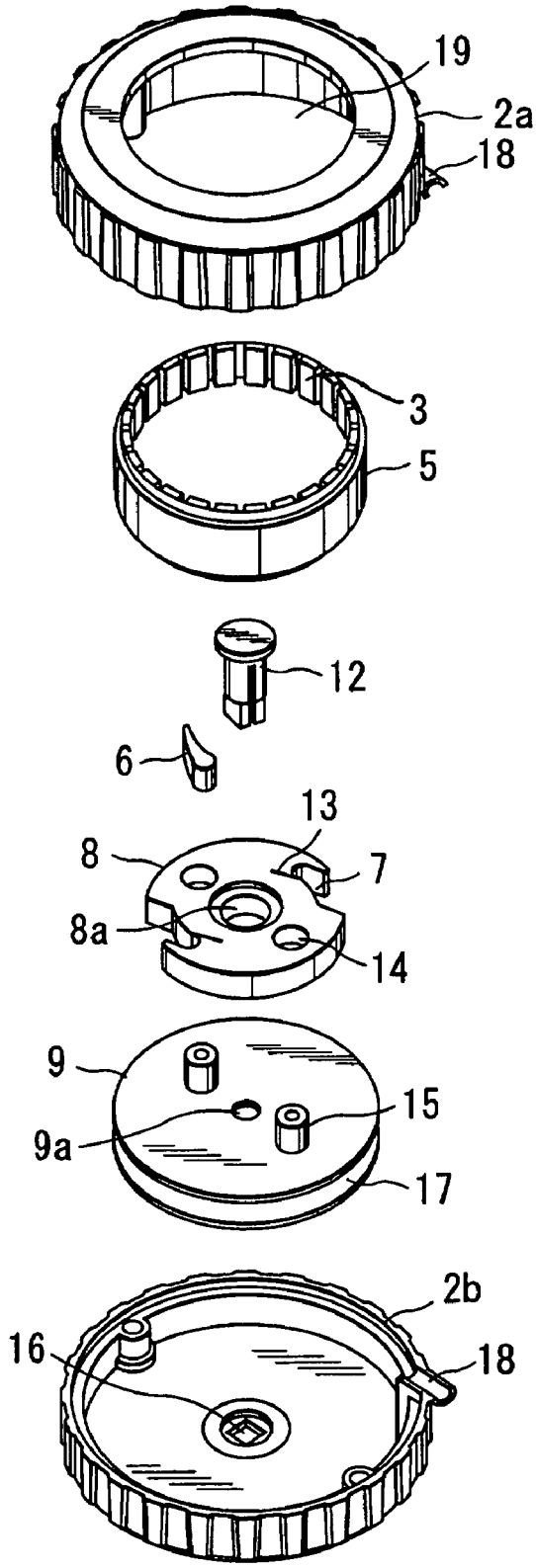
FIG. 4 is a disassembled perspective view as viewed from the back in FIG. 3.
Figure 5:
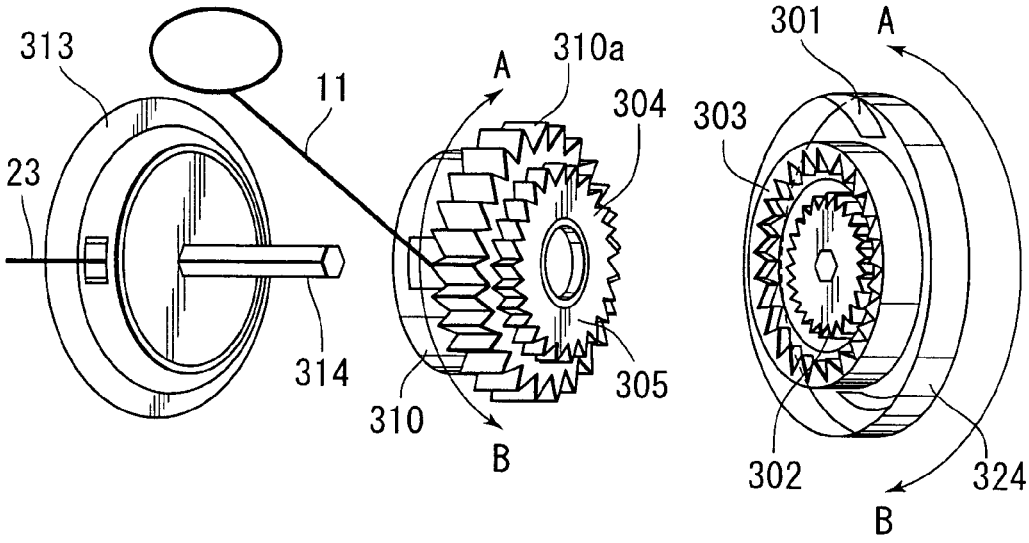
FIG. 5 is a disassembled perspective view which illustrates a shoestring tying apparatus according to a second embodiment of the present invention.
Figure 6:
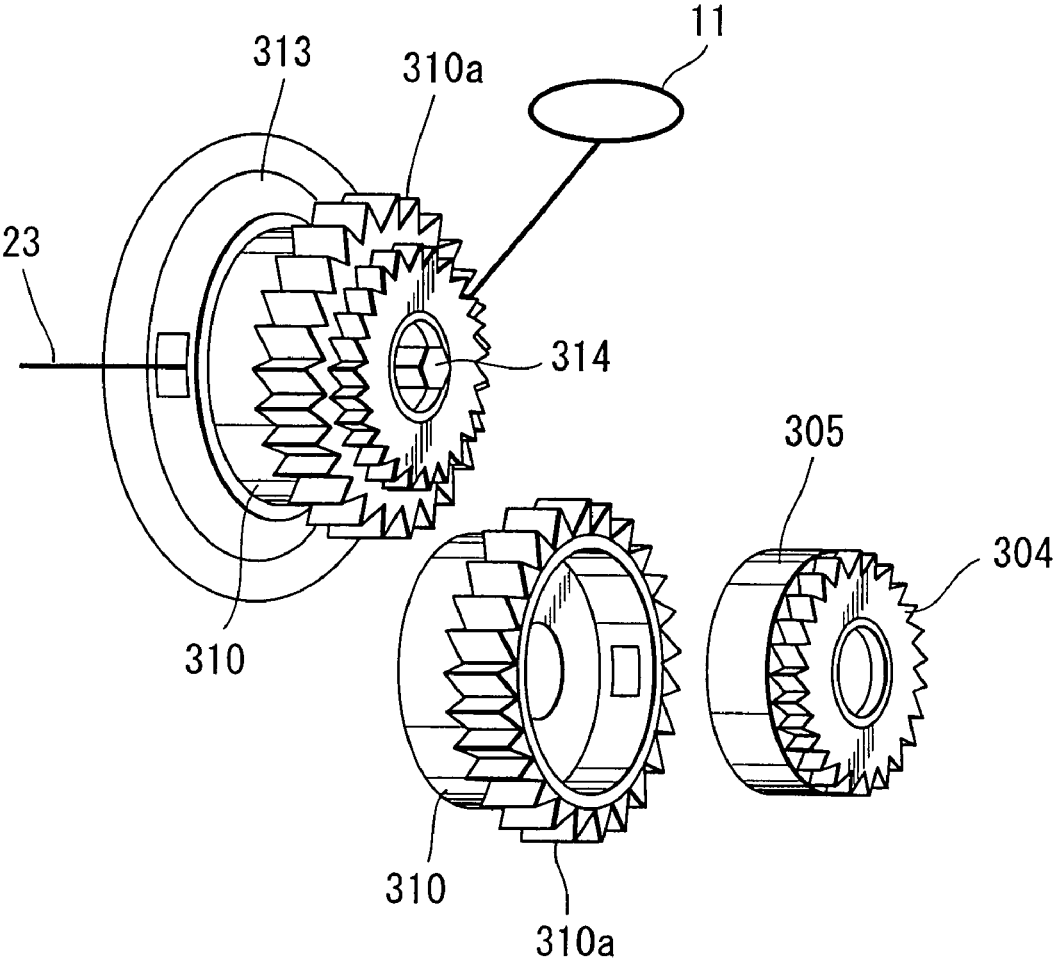
FIG. 6 is a disassembled perspective view for describing the internal configuration of the shoestring tying apparatus according to the second embodiment, wherein a cover member is omitted.
Figure 7A:
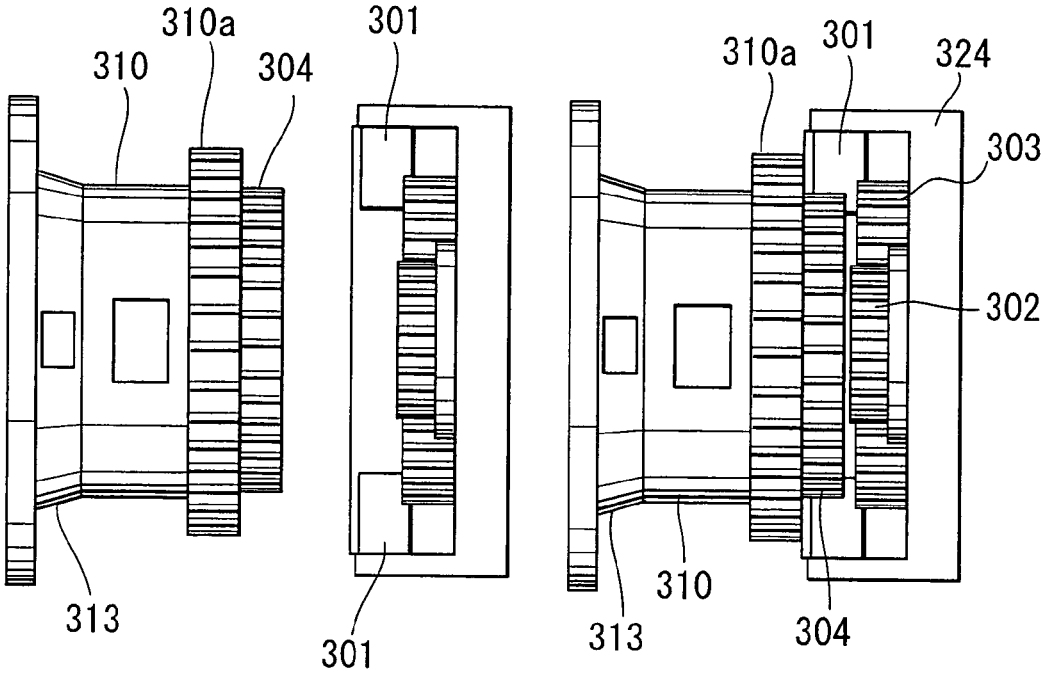
Figure 7B:
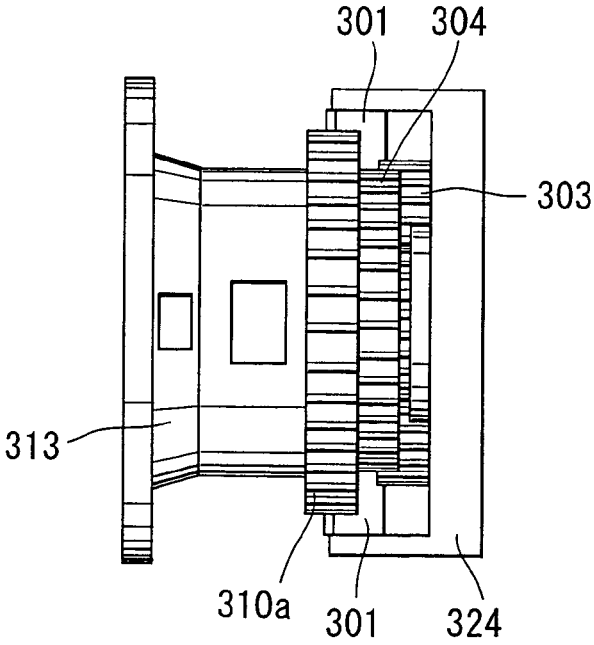
Figure 8:
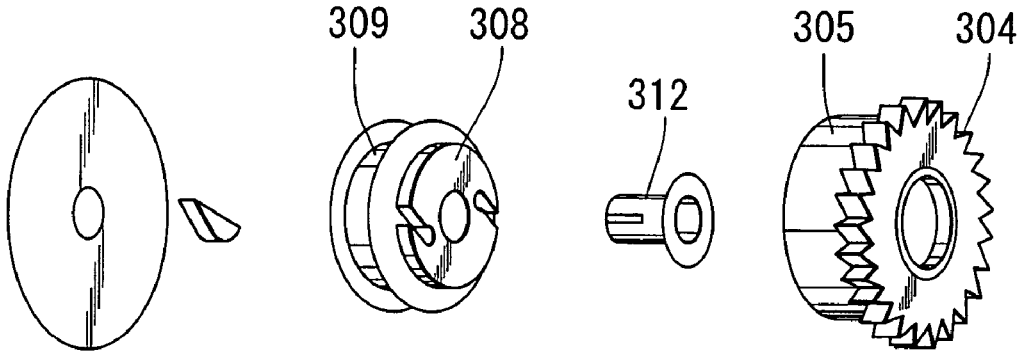
FIG. 8 is a disassembled perspective view which shows the internal configuration of a ratchet according to the second embodiment.
Figure 9:
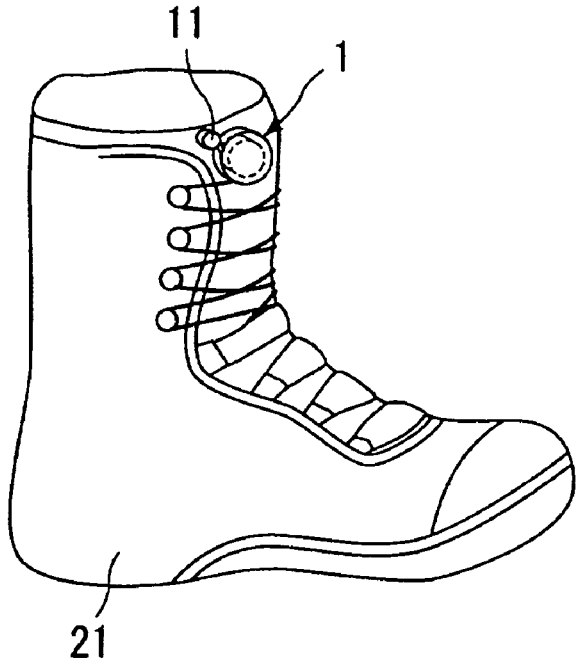
FIG. 9 is a perspective view which illustrates a shoe including the shoestring tying apparatus according to the present invention.
Figure 10:
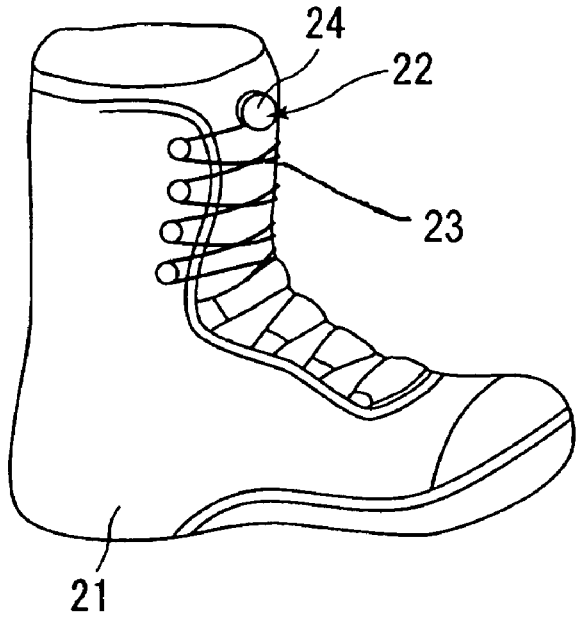
FIG. 10 is a perspective view which illustrates a shoe including a conventional shoestring tying unit.

FIG. 1 is a cross-sectional diagram which illustrates a shoestring tying apparatus according to a first embodiment of the present invention. FIG. 2 is a perspective view which illustrates the entire shoestring tying apparatus according to the first embodiment of the present invention. FIG. 3 is a disassembled perspective view of the shoestring tying apparatus shown in FIG. 1. FIG. 4 is a disassembled perspective view of the shoestring tying apparatus as viewed from the back in FIG. 3. FIG. 5 is a disassembled perspective view which illustrates a shoestring tying apparatus according to a second embodiment of the present invention. FIG. 6 is a disassembled perspective view for describing the internal configuration of the shoestring tying apparatus according to the second embodiment, wherein a cover member is omitted. FIGS. 7A and 7B are cross-sectional diagrams for describing the internal configuration of the shoestring tying apparatus according to the second embodiment, wherein FIG. 7A shows the state wherein an operating rotor is not engaged with a rotational member, and FIG. 7B shows the state wherein the operating rotor is engaged with the rotational member. FIG. 8 is a disassembled perspective view which shows the internal configuration of a ratchet according to the second embodiment. FIG. 9 is a perspective view which illustrates a shoe including the shoestring tying apparatus according to the present invention. FIG. 10 is a perspective view which illustrates a shoe including a conventional shoestring tying unit.

A shoestring tying apparatus according to the present invention comprises a fitting portion 3 serving as a connection portion for fitting to a rotational cap 24 which is a conventional operating rotor, or an external gear 304 for meshing an internal gear 303 provided to a rotational cap 324, and a rotational member 5 serving as driving means for rotating the fitting portion 3 or the external gear 304. Note that, as the aforementioned driving means, an automatic mechanism using a forced elastic member, an electric motor with a battery, or a manual mechanism wherein a cord, wire, or the like is manually operated for directly rotating the rotational member 5, may be employed for a driving source for rotating the rotational member 5.

Description will be made below regarding a shoestring tying apparatus including a manual mechanism serving as driving means, with reference to the drawings.

As shown in FIG. 1, a shoestring tying apparatus 1 shown in FIG. 1 according to a first embodiment includes a cover 2 (front cover 2*a* and back cover 2*b*) formed of colored resin for storing the internal configuration components thereof. The shoestring tying apparatus 1 further comprises a rotational member 5 having a configuration including a partition 5*a*, wherein a fitting portion 3 is formed on one side of the partition 5*a* for connecting to a fastening member 22 connected to a rotational cap 24 which is a conventional operating rotor or an outer rotational portion thereof with an internal gear 4 formed on the internal circumference on the other side of the partition 5*a*. The shoestring tying apparatus 1 also comprises a ratchet 8 including a pawl 6 at a pawl storage portion 7 for engaging with the internal gear 4, a spring storage member 9 which is in contact with the side of the ratchet 8, a helical spring 10 included in the spring storage member 9, an operating cord 11 connected to the spring storage member 9, and a rotational shaft 12.

One end of the spring 10 included in the aforementioned spring storage member 9 is fixed to the rotational shaft 12, and the other end is fixed to the back side of the spring storage member 9, or is extracted outside from an opening 9*b* on the outer face of the spring storage member 9 so as to be connected to the operating cord 11.

The ratchet 8 includes a plate spring (not shown) fixed to a slit 13 at the pawl storage portion 7, which is an elastic member for forcing the pawl 6 in the direction so that the pawl 6 engages with the internal gear 4 of the rotational member 5 at all times. Furthermore, the ratchet 8 includes one or more engaging openings 14 formed on one side thereof for engaging with protrusions 15 formed on the side of the spring storage member 9. Furthermore, the ratchet 8 and spring storage member 9 include shaft openings 8*a* and 9*a*, respectively, for rotatably holding the rotational shaft 12 fixedly fit to a support opening 16 on the back cover 2*b*.

Next, description will be made regarding the operation of the shoestring tying apparatus according to the present invention.

The cover 2 includes a combination of the front cover 2*a* and the back cover 2*b*. Furthermore, the cover 2 includes a through hole 18 on the circumference thereof or at a portion near the circumference thereof for inserting the operating cord 11 which is to be wound to the spring storage member 9. The front cover 2*a* includes a round opening 19 for inserting the fitting portion 3 therethrough, fit to the fastening portion (or the rotational cap 24) for the shoestring 23. On the other hand, the back cover 2*b* includes the support opening 16 at a position corresponding to the center line of the round opening 19.

As shown in FIGS. 3 and 4, while the shoestring tying apparatus has the round opening 19 on the side of the front cover for the fitting portion 3, the shape of the opening is not restricted to a round. The fitting portion 19 includes a slip-preventing portion 20 which is an uneven portion formed on the internal circumference thereof. The slip-preventing portion 20 is formed in order to hold the rotational cap 24 of the fastening member 22 for the shoestring 23, which is fit to the fitting portion 3, in a sure manner without slipping, and is formed of multiple grooves or the like, for example. An arrangement may be made wherein the fitting portion 3 is integrally formed on the rotational cap 24 serving as an operating rotor.

The spring storage member 9 for storing the spring 10 serving as an elastic member includes a recessed groove 17 on the outer face thereof, as shown in FIGS. 1 and 3. While the drawings show an arrangement wherein the ratchet 8 engages with the spring storage member 9 with the engaging openings 14 and the protrusions 15, an arrangement may be made wherein the ratchet 8 and the spring storage member 9 are formed integrally. The spring 10 is formed of a plate spring wound in a helical manner. The spring 10 is stored in the spring storage member 9 so as to be elastically pressed into contact with the inner face thereof.

With an another embodiment, an arrangement may be made wherein the spring storage member 9 does not include the opening 9*b* on the recessed groove 17 on the outer face thereof, and one end of the spring 10 is fixed to the inner face of the spring storage member 9 on the back of the recessed groove 17, and one end of the operating cord 11 is fixed to the recessed groove 17 on the outer face thereof, and is wound on the spring storage member 9 along the recessed groove 17.

With the present embodiment, the rotational shaft 12 passes through the shaft opening 9*a* of the spring storage member 9 including the spring 10, and is held by the support opening 16 of the back cover 2*b*. Furthermore, the base end of the spring 10 is fixed to the rotational shaft 12, and the other end serving as a free end is connected to the operating cord 11.

With the above-described configuration, upon the user pulling the operating cord 11, the spring storage member 9 fixed to the end of the operating cord 11 is rotated, or the spring 10 is extracted from the opening 9*b*, and accordingly, the spring storage member 9, where the spring 10 is wound and pressed into contact with the inner face on the back of the recessed groove 17, is rotated, whereby the ratchet 8 is rotated. With the arrangement wherein the free end of the spring 10 is fixed to the spring storage member 9, and one end of the operating cord 11 is fixed to the spring storage member 9, upon the user pulling the operating cord 11, the spring storage member 9 is rotated so as to wind up the spring 10. Subsequently, upon the user releasing the operating cord 11 from the pulling force, the operating cord 11 is retracted back and is wound on the spring storage member 9 along the recessed groove 17 formed on the outer face thereof due to the returning force of the spring 10.

Further description will be made below regarding the shoestring tying apparatus according to the present embodiment of the present invention.

As shown in the cross-sectional diagram shown in FIG. 1, with the shoestring tying apparatus according to the present embodiment having such a configuration, upon the user pulling a tab or the like at the end of the operating cord 11 by hand so as to extract the operating cord 11 from the shoestring tying apparatus 1, the spring storage member 9 is rotated so as to rotate the ratchet 8 where the spring storage member 9 engages therewith on the side, and the rotational member 5 is also rotated due to rotation of the internal gear 4 engaging the pawl 6 of the ratchet 8, thereby rotating the fastening member 22 for the shoestring 23 through the fitting portion 3 thereof with the slip-preventing portion 20. Subsequently, upon the user releasing the operating cord 11 from the pulling force, the spring storage member 9 rotates due to returning action of the spring 10, and accordingly, the operating cord 11 is stored so as to be wound on the spring storage member 9 on the outer face along the recessed groove 17. Note that, at this time, the pawl 6 of the ratchet 8 does not engage with the internal gear 4 of the rotational member 5, and accordingly, the ratchet 8 is rotated without load. Upon the user pulling the operating cord 11 again, the spring 10 is extracted, or the spring storage member 9 is rotated, whereby the rotational member 5 is rotated.

The operating cord 11 may be formed of a nylon cord, a metal wire, a belt, or the like, and a ring provided to one end of the operating cord 11. As described above, the other end of the operating cord 11 is fixed to the outer face of the spring storage member 9 including the spring 10 pressed into contact with the inner face thereof. The operating cord 11 is wound to the spring storage member 9 on the outer face thereof, and is extracted from the through hole 18 on the cover 2, as shown in FIG. 2.

Next, description will be made regarding a tying method for the shoestring using the shoestring tying apparatus 1 according to the present invention.

First, the fitting portion 3 of the shoestring tying apparatus 1 according to the present invention is fit to the rotational cap 24 (rotational member) of the fastening member 22 mounted on the shoe 21 shown in FIG. 10 (see FIG. 9), so as to tightly hold the rotational cap 24 through the slip-preventing portion 20 formed of grooves or the like. As a result, the fastening member 22 and the shoestring tying apparatus 1 are operated as a single unit.

Next, upon the user pulling the operating cord 11 so as to rotate the spring storage member 9, the ratchet 8 and the rotational member 5 are rotated, as described above. Thus, the fitting portion 3 integrally formed on the rotational member 5 is rotated so as to rotate the rotational cap 24 in the rotational direction for fastening the fastening member 22 of the shoe 21. The fastening member 22 has a conventional configuration for tying the shoestring 23 of the shoe 21, whereby the shoestring 23 is fastened by rotation thereof.

In this case, even in the event that the user only pulls the operating cord 11 a little, the rotational member 5 rotates several times. Accordingly, upon the user performing a simple pulling operation for the operating cord 11, the fitting portion 3 is rotated several dozen times, and accordingly, the fastening member 22 is easily rotated, whereby the shoestring is fastened. Thus, with the shoestring tying apparatus 1 according to the present invention, upon the user performing pulling operations wherein the operating cord 11 is alternately extracted and retracted several times, the fitting portion 3 and the fastening member 22 can be easily rotated several dozen times.

The shoestring tying apparatus 1 according to the present invention has a simple configuration wherein the ratchet 8 is disposed adjacent to the spring storage member 9, and the rotational member 5 includes the internal gear 4 and the fitting portion 3.

The spring 10 is included within the spring storage member 9 with one end thereof fixed to the rotational shaft 12 which is fit to the support opening 16 on the back cover 2*b*. The ratchet 8 engages with the spring storage member 9, and the pawl 6 of the ratchet 8 engages with the internal gear 4 of the rotational member 5, thereby enabling the rotational member 5 to be rotated in a sure manner. The complete configuration of the shoestring tying apparatus 1 further includes the front cover 2*a* fit to the other configuration.

As described above, with the shoestring tying apparatus 1 according to the present invention, the rotational cap 24 of the conventional fastening member can be easily rotated several dozen times by performing a pulling operation wherein the operating cord 11 is alternately extracted and retracted just once or twice. As described above, the user performs the pulling operation so that the operating cord 11 is alternately extracted and retracted, and there is no need to rotate the fastening member by hand. Accordingly, the tying operation becomes markedly simple, thereby eliminating troublesome tasks for the user. Furthermore, even in the event that the fingers of the user are numbed with cold in the winter season, the user can easily tie the shoestring without trouble. Furthermore, as described above, the shoestring is tied by simply performing the fastening operation wherein the operating cord 11 is alternately extracted and retracted several times, thereby enabling the shoestring to be tied in a quick and sure manner.

While the cover 2 of the shoestring tying apparatus 1 described above is formed in a round shape as shown in the drawings, it is needless to say that the shape thereof is not restricted being round, but rather, the cover 2 may be formed in any shape which improves portability and appearance.

Next, description will be made regarding a shoestring tying apparatus according to a second embodiment with reference to FIGS. 5 through 8.

As shown in the drawings, a cap 324 includes multiple pawls 301 on the inner face thereof for engaging with a gear wheel so as to rotate in one direction, an internal gear 303 on the inner side of the pawls 301, and a gear wheel 302 on the inner side of the internal gear 303 for being moved within the cap 324. A hexagonal shaft 314 is fit to the gear wheel 302. Note that the cap 324 can be slidably moved along the hexagonal shaft 314.

On the other hand, a rotational member 305 includes an external gear 304 for engaging with the internal gear 303 of the cap 324, a spring therewithin for forcing the operating cord 11, and a shaft 312 which is rotatably fit to the aforementioned hexagonal shaft 314. The rotational member 305 further includes a ratchet 308 for engaging with the internal gear provided on the inner face thereof, and a cylinder 309 which is an internal core for storing the operating cord 11 so as to be wound thereto. The rotational member 305 is rotatably fit to an outer cylinder 310 fixed to a base 313. The outer cylinder 310 includes an external gear 310*a* on the outer face thereof for engaging with the aforementioned pawls 301 of the cap 324.

The base 313 is fixed at a predetermined position of the shoe 21, and includes the rotational cylinder for winding both ends of the shoestring 23, and the hexagonal shaft 314.

Description will be made with regard to the operation of the shoestring tying apparatus having this configuration according to the present embodiment.

First, description will be made regarding the state of the shoestring tying apparatus shown in FIG. 7A with reference to FIGS. 5 and 7A. Upon the user rotating the cap 324 in the direction of A with the tips of the pawls 301 on the inner face of the cap 324 slidably being in contact with the outer face of the external gear 310*a* of the outer cylinder 310, the hexagonal shaft 314 is rotated, and accordingly, the shoestring 23 is tied (description regarding the internal configuration will be omitted). Next, upon the user releasing the cap 324 from the base 313 (see FIG. 7A), the engagement of the external gear 310*a* of the outer cylinder 310 and the pawl 301 is released, whereby the shoestring 23 is released.

Next, description will be made regarding the state of the above-described shoestring tying apparatus shown in FIG. 7B. Upon the user pulling the operating cord 11, the ratchet 308 is rotated against the elastic force of the spring included in the outer cylinder 309, whereby the rotational member 305 is rotated. The external gear 304 of the rotational member 305 meshes with the internal gear 303 of the cap 324, and accordingly, the cap 324 is rotated, whereby the shoestring 23 is fastened through the hexagonal shaft 314. Subsequently, upon the user releasing the operating cord 11 so as to be returned to the initial position, the ratchet 308 is rotated, but the rotational member 305 is not rotated. Accordingly, upon the user performing pulling operations wherein the operating cord 11 is alternately extracted and retracted several times, the cap 324 and the hexagonal shaft 314 are rotated, whereby the shoestring 23 is tied.

As described above, upon the user pulling the operating cord 11, the ratchet 308 is rotated, and accordingly, the rotational member 305 and external gear 304 are rotated, as well. Note that the spring is wound up at the same time of the spring being rotated. The spring is rotated several times with each pulling operation. At the time of the user releasing the engagement, the spring is returned to the initial state.

What is claimed is:

1. A shoestring tying apparatus comprising:

a fastening member for tightening a shoestring, said fastening member including a disk to be connected to one end of the shoestring, and including an operating member for rotating said disk so as to wind the shoestring;

a rotational member operable to:

engage said fastening member and rotate said operating member of said fastening member in a winding direction so as to wind the shoestring around said disk when said rotational member is rotated in a predetermined direction, thereby tightening the shoestring;

engage said fastening member and prevent rotation of said operating member of said fastening member in a direction opposite the winding direction when rotation of said rotational member is stopped, thereby maintaining tension of the shoestring; and disengage said fastening member to allow rotation of said operating member of said fastening member in the direction opposite the winding direction, thereby releasing the tension of the shoestring;

a fitting portion for connecting said rotational member to said operating member of said fastening member; and a driving mechanism for rotating said rotational member in the predetermined direction, said driving mechanism being operable to manually or automatically rotate said operating member via said rotational member so as to rotate said disk of said fastening member, thereby tightening the shoestring, and said driving mechanism including (i) a spring member such that as said rotational member is rotated in the predetermined direction said spring member is wound, (ii) a cylindrical storage member having a rotational shaft, with said spring member fixed to said rotational shaft, (iii) an operating cord to be wound on an outer circumference of said storage member, and (iv) a restricting device including an engaging member, wherein said storage member, said spring member, said operating cord, and said restricting device are arranged and operable to rotate said rotational member in the predetermined direction, and operable to prevent said rotational member from rotating in a direction opposite the predetermined direction.

2. The shoestring tying apparatus of claim 1, wherein said restricting device further includes a ratchet, said engaging member comprising a pawl arranged in a pawl storage section of said ratchet.

3. The shoestring tying apparatus of claim 2, wherein said rotational member has an internal gear portion, said restricting device being arranged such that said pawl is operable to engage said internal gear portion of said rotational member.

4. The shoestring tying apparatus of claim 2, wherein said rotational member is located between said driving member and said fastening member.

5. A shoestring tying apparatus comprising:

a fastening member for tightening a shoestring, said fastening member including a disk to be connected to one end of the shoestring, and including an operating member for rotating said disk so as to wind the shoestring;

a rotational member including a cylinder portion and a rotating shaft, said rotational member being operable to:

engage said fastening member and rotate said operating member of said fastening member in a winding direction so as to wind the shoestring around said disk when said rotational member is rotated in a predetermined direction, thereby tightening the shoestring;

engage said fastening member and prevent rotation of said operating member of said fastening member in a direction opposite the winding direction when rotation of said rotational member is stopped, thereby maintaining tension of the shoestring; and disengage said fastening member to allow rotation of said operating member of said fastening member in the direction opposite the winding direction, thereby releasing the tension of the shoestring;

a fitting portion for connecting said rotational member to said operating member of said fastening member;

an elastic member in said cylinder portion of said rotational member, said elastic member having a first end fixed to said rotating shaft of said rotational member, and being wound when said rotational member is rotated in the predetermined direction so as to tighten the shoestring;

a ratchet in said cylinder portion of said rotational member so as to have the same axis of rotation as said rotational member, said ratchet including a pawl for engaging said rotational member when said ratchet is rotated in the predetermined direction, and for disengaging said rotational member when said ratchet is rotated in a direction opposite the predetermined direction due to an elastic force of said elastic member;

an operating cord to be wound on said cylinder portion of said rotational member; and a two-piece cover member for storing said fitting portion, said rotational member, said elastic member, said ratchet, and said wound operating cord, said operating cord being arranged to be extracted from said cover member when pulled;

wherein said operating cord, said fitting portion, said rotational member, said elastic member, and said ratchet are arranged such that:

when said operating cord is pulled to be extracted from said cover member, said ratchet is rotated in the predetermined direction and said pawl of said ratchet engages said rotational member so that said rotational member and said fitting portion are rotated in the predetermined direction, and said elastic member is wound;

when said operating cord is released after being extracted from said cover member, said operating cord is wound on said cylinder portion of said rotational member due to the elastic force of said elastic member, and said pawl of said ratchet disengages from said rotational member so that only said ratchet is rotated in the direction opposite the predetermined direction without rotating said rotational member; and when said operating cord is again pulled to be extracted from said cover member again, said ratchet is rotated in the predetermined direction so that said rotational member is rotated in the predetermined direction.

6. The shoestring tying apparatus of claim 5, wherein said fitting portion is integrally connected to said rotational member such that said fitting portion and said rotational member have a one-piece construction, said fitting portion having a contact surface for contacting a contact surface of said operating member.

7. A shoestring tying apparatus comprising:

a fastening member for tightening a shoestring, said fastening member including a disk to be connected to one end of the shoestring, and including an operating member for rotating said disk so as to wind the shoestring;

a rotational member including a fitting portion and a cylinder portion having an internal gear adjacent to said fitting portion, said rotational member being operable to:

engage said fastening member and rotate said operating member of said fastening member in a winding direction so as to wind the shoestring around said disk when said rotational member is rotated in a predetermined direction, thereby tightening the shoestring;

engage said fastening member and prevent rotation of said operating member of said fastening member in a direction opposite the winding direction when rotation of said rotational member is stopped, thereby maintaining tension of the shoestring; and disengage said fastening member to allow rotation of said operating member of said fastening member in the direction opposite the winding direction, thereby releasing the tension of the shoestring;

a ratchet having pawl-storage sections on an outer circumference thereof, and having a shaft fitting opening at the center thereof;

a plurality of pawls arranged in said pawl-storage sections of said ratchet so as to be forced at all times in an engagement direction by an elastic member to thereby engage said internal gear of said rotational member;

a rotational shaft arranged within said shaft fitting opening of said ratchet and within said cylinder portion of said rotational member;

a spring storage member connected to said ratchet, said spring storage member including a recessed groove on an outer circumference thereof, including a storage space, and including a through-hole for rotatably receiving said rotational shaft;

an operating cord wound on said recessed groove of said spring storage member;

a helical spring stored in said storage space of said spring storage member, said helical spring having a first end fixed to said rotational shaft and having a second end connected to a first end of said operating cord; and a cover member having a fitting opening at a center of a back surface thereof for receiving and supporting said rotational shaft, said cover member being shaped and arranged to cover said spring storage member and said rotational member, and shaped and arranged to allow a second end of said operating cord to be pulled so as to extract said operating cord from said cover member.

8. The shoestring tying apparatus of claim 7, wherein said fitting portion is integrally formed on said operating member so that said fitting portion and said operating member have a one-piece construction.

9. The shoestring tying apparatus of claim 7, wherein said ratchet includes an engaging opening on a side thereof, said spring storage member including a protrusion engaging said engaging opening of said ratchet so as to connect said ratchet to said spring storage member.

10. The shoestring tying apparatus of claim 7, wherein said cover member includes a back cover portion having said fitting opening at a center thereof, and includes a front cover portion having an opening, said front cover portion being fit to said back cover portion.

11. The shoestring tying apparatus of claim 7, wherein said fitting portion is integrally connected to said rotational member such that said fitting portion and said rotational member have a one-piece construction, said fitting portion having a contact surface for contacting a contact surface of said operating member.

12. A shoestring tying apparatus comprising:

a fastening member for tightening a shoestring, said fastening member including a disk to be connected to one end of the shoestring;

a rotational member including an internal gear on an inner face thereof, and including an engaging gear, said rotational member being operable to:

engage said fastening member and rotate said fastening member in a winding direction so as to wind the shoestring around said disk when said rotational member is rotated in a predetermined direction, thereby tightening the shoestring;

engage said fastening member and prevent rotation of said fastening member in a direction opposite the winding direction when rotation of said rotational member is stopped, thereby maintaining tension of the shoestring; and disengage said fastening member to allow rotation of said fastening member in the direction opposite the winding direction, thereby releasing the tension of the shoestring;

an operating member for rotating said disk of said fastening member so as to wind the shoestring, said operating member including:

a plurality of pawls on an inner face thereof;

a cylindrical engaging gear for engaging said engaging gear of said rotational member when said rotational member rotates in the predetermined direction; and a gear set;

a ratchet for engaging said gear set of said operating member;

a spring storage member including a plurality of pawls supported with shafts for engaging said internal gear of said rotational member, and including a helical spring;

an operating cord having an end fixed to an end of said helical spring, or fixed to an outer circumference of said spring storage member, so as to wind up said helical spring of said spring storage member; and wherein said operating member, said fastening member, said rotational member, said ratchet, said spring storage member, and said operating cord are arranged so that said fastening member is rotated by manually turning said operating member, or by pulling said operating cord so as to rotate said ratchet and said rotational member.

13. The shoestring tying apparatus of claim 12, wherein said rotational member is located between said driving member and said fastening member.

* * * * *